US005441666A

United States Patent [19]

Dotolo

[11] Patent Number: 5,441,666

[45] Date of Patent: Aug. 15, 1995

[54] HAND CLEANER

[75] Inventor: Vincent A. Dotolo, Clearwater, Fla.

[73] Assignee: Citra Science Ltd., Largo, Fla.

[21] Appl. No.: 284,380

[22] Filed: Aug. 2, 1994

[51] Int. Cl.[6] ..... C11D 10/04

[52] U.S. Cl. ..... 252/170; 252/164; 252/165; 252/166; 252/167; 252/171; 252/174.22; 252/174.23; 252/174.24; 252/DIG. 5

[58] Field of Search ..... 252/164, 165, 166, 167, 252/170, 171, 174.22, 174.23, 174.24, DIG. 5

[56] References Cited

U.S. PATENT DOCUMENTS

| | | | |
|---|---|---|---|
| Re. 33,210 | 5/1990 | Stoufer | 252/153 |
| 2,709,683 | 5/1955 | Sarchet | 252/89 |
| 4,414,128 | 11/1983 | Goffinet | 252/111 |
| 4,533,487 | 8/1985 | Jones | 252/170 |
| 4,561,991 | 12/1985 | Herbots et al. | 252/118 |
| 4,620,937 | 11/1986 | Dellutri | 252/143 |
| 5,019,174 | 5/1991 | Wallach | 134/40 |
| 5,279,759 | 1/1994 | Rebrovic et al. | 252/132 |
| 5,290,471 | 3/1994 | Greene et al. | 252/108 |
| 5,298,181 | 3/1994 | Choy et al. | 252/95 |
| 5,360,580 | 11/1994 | Dotolo et al. | 252/542 |

FOREIGN PATENT DOCUMENTS

| | | |
|---|---|---|
| 0174711 | 3/1986 | European Pat. Off. . |
| 0269178 | 6/1988 | European Pat. Off. . |
| 1603047 | 11/1981 | United Kingdom . |
| W094/05751 | 3/1994 | WIPO . |

*Primary Examiner*—Paul Lieberman
*Assistant Examiner*—Wyatt B. Pratt
*Attorney, Agent, or Firm*—Donald R. Fraser

[57] ABSTRACT

Abrasive and non-abrasive hand cleaners are prepared from d-limonene, C-11 alcohol ethoxylate, butylated hydroxytoluene, polyoxyethylene (20) sorbitan monooleate, disodium EDTA, and acrylic copolymer emulsifier, propylene glycol, water, and optionally, pumice.

19 Claims, No Drawings

HAND CLEANER

FIELD OF THE INVENTION

The present invention relates generally to hand cleaners. More particularly, the present invention is directed to a hand cleaner comprising, inter alia, d-limonene and optionally pumice.

BACKGROUND OF THE INVENTION

Hand cleaners generally are made from simple mixtures of sodium salts of long-chain fatty acids. Perfumes, dyes, and germicides are many times added; and even air can be added to make the cleaners lighter than water. The molecules of such hand cleaners generally contain a polar end and a long carbon chain non-polar end. The polar ends of the molecules are water-soluble while the non-polar ends are oil-soluble. Thus, the cleaner emulsifies the fat and grease that makes up the dirt being cleaned, forming a stable emulsion of oily droplets in water.

A problem with the cleaners of the prior art is caused by the inherent properties of the ingredients. Most such cleaners contain harsh chemicals which are caustic and environmentally undesirable. Moreover, many such cleaners are not biodegradable.

It would be desirable to formulate a hand cleaner which is both non-irritating to the skin and at the same time biodegradable.

SUMMARY OF THE INVENTION

Accordant with the present invention, a non-irritating biodegradable hand cleaner surprisingly has been discovered. The hand cleaner consists of d-limonene, C-11 alcohol ethoxylate, butylated hydroxytoluene, polyoxyethylene (20) sorbitan monooleate, disodium EDTA, an acrylic copolymer emulsifier, propylene glycol, water, and optionally pumice. The inventive formulation is particularly useful for cleaning a persons's hands, without irritating same.

DETAILED DESCRIPTION OF THE PREFERRED EMBODIMENT

The formulation according to the present inventor consists of a precise combination of d-limonene, C-11 alcohol ethoxylate, butylated hydroxytoluene, polyoxyethylene (20) sorbitan monooleate, disodium EDTA, an acrylic copolymer emulsifier, propylene glycol, water and optionally, pumice.

D-limonene is a terpene which occurs naturally in all living plants. It is a monocyclic unsaturated terpene which is generally a by-product of the citrus industry, derived from the distilled rind oils of oranges, grapefruits, lemons, and the like. A discussion of d-limonene and its derivation from numerous sources is set forth in Kesterson, J. W., "Florida Citrus Oil," Institute of Food and Agriculture Sciences, University of Florida, December, 1971. D-limonene is commercially available from Florida Chemical Company and from SMC Glidco Organics. D-limonene may be present in the inventive formulation at a concentration from about 18 to about 45 weight percent. Preferably, the concentration is about 30 weight percent.

C-11 alcohol ethoxylate is present as a detergent in the hand cleaner according to the present invention. The concentration of the C-11 alcohol ethoxylate may range from about 0.04 to about 3 weight percent. Preferably, the concentration is about 1 weight percent. A preferred C-11 alcohol ethoxylate is available from Vari Water and Rogers Inc., Kirkland, Wash., carrying the product designation "NEODOL 1-5".

Butylated hydroxytoluene is a well-known antioxidant used in the formulation of the present invention. The butylated hydroxytoluene may be present at a concentration from about 0.05 to about 4 weight percent. Preferably, the concentration is about 0.60 weight percent.

Polyoxyethylene (2) sorbitan monooleate is present in the inventive formulation as a stabilizer. A preferred polyoxyethylene (20) sorbitan monooleate may be obtained from Vari Waters & Rogers Inc. carrying the product designation "TWEEN (R) 80". The concentration of the polyoxyethylene (20) sorbitan monooleate may range from about 0.04 to about 2.5 weight percent. Preferably, the concentration is about 0.4 weight percent.

Disodium EDTA is a well-known chelating and sequestering agent used in the present formulation. It may be present in the hand cleaner at a concentration from about 0.05 to about 4 weight percent. Preferably, the concentration is about 0.6 weight percent.

The hand cleaner formulation according to the present invention utilizes an acrylic copolymer emulsifier. A preferred acrylic copolymer emulsifier may be obtained from the B.F. Goodrich Company, Cleveland, Ohio carrying the product designation "PEMULEN TR-1". The acrylic copolymer emulsifier may be present at a concentration from about 0.04 to about 2.50 weight percent. Preferably, the concentration is about 0.40 weight percent.

Propylene glycol is a well-known material which is added to the present formulation as a humectant and general skin conditioner. The propylene glycol may be present in the inventive formulation at a concentration from about 2 to about 8 weight percent. Preferably, the concentration is about 4 weight percent.

Water is added to the hand cleaner of the present invention to make up the balance of the weight of the hand cleaner.

The aforementioned ingredients may be combined and mixed in conventional high-shear mixing equipment, to form a non-abrasive hand cleaner, according to the present invention. Alternatively, an abrasive version of the hand cleaner may be prepared by adding an abrasive material such as, for example, pumice to the ingredients listed hereinabove. The pumice may be added to the formulation at a concentration ranging from about 2.5 to about 11 weight percent. Preferably, the concentration is about 7 percent.

In accordance with the provisions of the patent statutes, the present invention has been described in what is considered to represent its preferred embodiment. However, it should be understood that the invention can be practiced otherwise than as specifically illustrated and described without departing from its spirit or scope.

EXAMPLES

The following ingredients are mixed and blended together in a conventional high-shear mixer in approximately the weight percentages indicated, to form hand cleaners according to the present invention.

TABLE 1

HAND CLEANER FORMULATIONS

| Ingredient | Non-Abrasive Formulation | Abrasive Formulation |
|---|---|---|
| d-limonene (1) | 30 | 30 |
| C-11 alcohol ethoxylate (2) | 1 | 1 |
| butylated hydrorytoluene | 0.6 | 0.6 |
| polyoxyethylene (20) sorbitan monooleate (3) | 0.4 | 0.4 |
| disodium EDTA | 0.6 | 0.6 |
| acrylic copolymer emulsifier (4) | 0.4 | 0.4 |
| propylene glycol | 4 | 4 |
| pumice | — | 7 |
| water | 63 | 56 |

(1) GLIDESAFE, from SMC Glidco Organics.
(2) NEODOL 1-5, from Van Waters & Rogers, Inc.
(3) TWEEN (R) 80, from Van Waters & Rogers, Inc.
(4) PERMULEN TR-1, from BFGoodrich Company.

These Examples may be repeated with similar success by substituting the generically or specifically described ingredients and/or concentrations recited herein for those used in the preceding Examples.

From the foregoing description, one ordinarily skilled in the art can easily ascertain the essential characteristics of this invention and, without departing from its spirit or scope, can make various changes and modification to the invention to adapt it to various usages and conditions.

What is claimed is:

1. A hand cleaner, consisting of:
d-limonene;
C-11 alcohol ethoxylate;
butylated hydroxytoluene;
polyoxyethylene (20) sorbitan monooleate;
disodium EDTA;
acrylic copolymer emulsifier;
propylene glycol;
optionally, pumice; and
the balance, water.

2. The hand cleaner according to claim 1, wherein the d-limonene concentration ranges from about 18 to about 45 weight percent.

3. The hand cleaner according to claim 1, wherein the C-11 alcohol ethoxylate concentration ranges from about 0.04 to about 3 weight percent.

4. The hand cleaner according to claim 1, wherein the butylated hydroxytoluene concentration ranges from about 0.05 to about 4 weight percent.

5. The hand cleaner according to claim 1, wherein the polyoxyethylene (20) sorbitan monooleate concentration ranges from about 0.04 to about 2.5 weight percent.

6. The hand cleaner according to claim 1, wherein the disodium EDTA concentration ranges from about 0.05 to about 4 weight percent.

7. The hand cleaner according to claim 1, wherein the acrylic copolymer emulsifier concentration ranges from about 0.04 to about 2.5 weight percent.

8. The hand cleaner according to claim 1, wherein the propylene glycol concentration ranges from about 2 to about 8 weight percent.

9. The hand cleaner according to claim 1, wherein the pumice concentration ranges from about 2.5 to about 11 weight percent.

10. The hand cleaner according to claim 2, wherein the d-limonene concentration is about 30 weight percent.

11. The hand cleaner according to claim 3, wherein the C-11 alcohol ethoxylate concentration is about 1 weight percent.

12. The hand cleaner according to claim 4, wherein the butylated hydroxytoluene concentration is about 0.6 weight percent.

13. The hand cleaner according to claim 5, wherein the polyoxyethylene (20) sorbitan monooleate concentration is about 0.4 weight percent.

14. The hand cleaner according to claim 6, wherein the disodium EDTA concentration is about 0.6 weight percent.

15. The hand cleaner according to claim 7, wherein the acrylic copolymer emulsifier concentration is about 0.4 weight percent.

16. The hand cleaner according to claim 8, wherein the propylene glycol concentration is about 4 weight percent.

17. The hand cleaner according to claim 9, wherein the pumice concentration is about 7 weight percent.

18. A non-abrasive hand cleaner, consisting of:
about 30 weight percent d-limonene;
about 1 weight percent C-11 alcohol ethoxylate;
about 0.6 weight percent butylated hydroxytoluene;
about 0.4 weight percent polyoxyethylene (20) sorbitan monooleate;
about 0.6 weight percent disodium EDTA;
about 0.4 weight percent acrylic copolymer emulsifier;
about 4 weight percent propylene glycol; and
the balance, water.

19. An abrasive hand cleaner, consisting of:
about 30 weight percent d-limonene;
about 1 weight percent C-11 alcohol ethoxylate;
about 0.6 weight percent butylated hydroxytoluene;
about 0.4 weight percent polyoxyethylene (20) sorbitan monooleate;
about 0.6 weight percent disodium EDTA;
about 0.4 weight percent acrylic copolymer emulsifier;
about 4 weight percent propylene glycol;
about 7 weight percent pumice; and
the balance, water.

* * * * *